US007757358B2

(12) United States Patent
Hoarau et al.

(10) Patent No.: US 7,757,358 B2
(45) Date of Patent: Jul. 20, 2010

(54) SHEET RETENTION MECHANISMS FOR SPRING CLAMP BINDERS

(75) Inventors: Eric Hoarau, San Francisco, CA (US); Steven W. Trovinger, Los Altos, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 269 days.

(21) Appl. No.: 11/681,636

(22) Filed: Mar. 2, 2007

(65) Prior Publication Data

US 2008/0213032 A1 Sep. 4, 2008

(51) Int. Cl.

| | |
|---|---|
| ***B42F 3/00*** | (2006.01) |
| ***B42F 13/12*** | (2006.01) |
| ***B42F 1/00*** | (2006.01) |
| ***B42F 1/02*** | (2006.01) |
| ***A44B 1/04*** | (2006.01) |
| ***A44B 11/25*** | (2006.01) |
| ***A44B 17/00*** | (2006.01) |

(52) U.S. Cl. ..... 24/67 R; 402/70; 24/67.3; 24/67.11

(58) Field of Classification Search ..... 24/67 R, 24/67.1, 67.3, 67.5, 67.7, 67.9, 67.11, 545, 24/555, 563, 456; 281/21.1, 15.1; 402/73, 402/70, 500, 502

See application file for complete search history.

(56) References Cited

U.S. PATENT DOCUMENTS

| | | | | | |
|---|---|---|---|---|---|
| 186,815 | A | * | 1/1877 | Edwards | 24/67.3 |
| 307,817 | A | * | 11/1884 | Tapley | 24/703.5 |
| 360,960 | A | * | 4/1887 | Hamilton | 24/67.5 |
| 475,425 | A | | 5/1892 | Vawter | |
| 560,353 | A | * | 5/1896 | Haarvig | 24/67.5 |
| 797,746 | A | * | 8/1905 | Pitt | 24/67.5 |
| 881,514 | A | | 3/1908 | Wiedeman | |
| 887,979 | A | | 5/1908 | Stockwell | |
| 1,197,314 | A | * | 9/1916 | Wells | 281/45 |
| 1,280,154 | A | * | 10/1918 | Buchan | 24/67.5 |
| 1,443,522 | A | * | 1/1923 | Buchan | 24/67.5 |
| 1,633,070 | A | * | 6/1927 | Crump | 281/48 |
| 1,741,909 | A | * | 12/1929 | Belohlavek | 24/67.11 |
| 1,844,516 | A | * | 2/1932 | Meyer et al. | 412/8 |
| 1,914,859 | A | * | 6/1933 | Hull | 281/34 |
| 1,949,625 | A | | 3/1934 | Ritzhaupt | |

(Continued)

FOREIGN PATENT DOCUMENTS

| | | |
|---|---|---|
| CA | 2050244 | 3/1992 |

(Continued)

OTHER PUBLICATIONS

PCT Search Report in Application No. PCT/US2008/002695, filed Feb. 28, 2008, search report dated Oct. 16, 2008.

(Continued)

*Primary Examiner*—Dana Ross
*Assistant Examiner*—Kyle Grabowski

(57) ABSTRACT

Spring clamp binders that include sheet retention mechanisms that provide improved performance and increase manufacturing efficiency and cost-effectiveness are described. The spring clamp binders have a cover and one or more spring clamps for holding one or more items, including sheets of physical media, such as loose sheets of paper, pages of a photoalbum, and other types of physical media. Methods of manufacturing spring clamp binders also are described.

27 Claims, 10 Drawing Sheets

U.S. PATENT DOCUMENTS

| | | | | | |
|---|---|---|---|---|---|
| 2,176,567 | A | | 10/1939 | Ellis | |
| 2,347,278 | A | | 4/1944 | Pitt | |
| 3,599,294 | A | * | 8/1971 | Lawes | 24/67.7 |
| 3,881,203 | A | | 5/1975 | Giulie | |
| 3,957,287 | A | | 5/1976 | Hall | |
| 4,114,240 | A | | 9/1978 | Nackenson | |
| 4,178,201 | A | | 12/1979 | Power | |
| 4,402,530 | A | | 9/1983 | Daguerre | |
| 4,624,480 | A | | 11/1986 | Marthaler | |
| 4,832,369 | A | | 5/1989 | Johnson | |
| 4,832,371 | A | | 5/1989 | Mugnai | |
| 4,986,713 | A | | 1/1991 | Zoltner et al. | |
| 5,015,115 | A | | 5/1991 | Mandolesi | |
| 5,015,135 | A | | 5/1991 | Chamings | |
| 5,035,447 | A | | 7/1991 | Lolli | |
| 5,061,139 | A | | 10/1991 | Zoltner | |
| 5,066,182 | A | * | 11/1991 | Stonebraker et al. | 412/3 |
| 5,156,419 | A | | 10/1992 | Minch | |
| 5,226,527 | A | | 7/1993 | Maurer | |
| 5,314,283 | A | | 5/1994 | Zoltner | |
| 5,330,229 | A | | 7/1994 | Zoltner | |
| 5,539,963 | A | * | 7/1996 | Fujiwara et al. | 24/536 |
| 5,562,309 | A | | 10/1996 | Brink et al. | |
| 5,574,519 | A | | 11/1996 | Mancino et al. | |
| 5,647,106 | A | * | 7/1997 | Hogan | 24/704.1 |
| 5,685,530 | A | | 11/1997 | DeLisa | |
| 5,697,131 | A | | 12/1997 | Hunt | |
| 5,716,181 | A | | 2/1998 | Ebel | |
| 5,733,087 | A | | 3/1998 | Gwyn | |
| 5,873,601 | A | | 2/1999 | Peleman | |
| 5,938,241 | A | * | 8/1999 | Wilson | 281/36 |
| 5,941,569 | A | | 8/1999 | Solomons | |
| 5,944,353 | A | | 8/1999 | Sato | |
| 6,149,200 | A | | 11/2000 | Lockhart | |
| 6,155,763 | A | | 12/2000 | Parker | |
| 6,322,867 | B1 | | 11/2001 | Rush | |
| 6,340,178 | B1 | | 1/2002 | Nkanishi et al. | |
| 6,422,797 | B2 | * | 7/2002 | Pas | 412/33 |
| 6,428,260 | B1 | | 8/2002 | Parker | |
| 6,581,970 | B1 | | 6/2003 | Lein | |
| 6,599,073 | B1 | | 7/2003 | Hartwig | |
| 6,672,815 | B2 | | 1/2004 | Parker | |
| 6,685,415 | B2 | | 2/2004 | Rush et al. | |
| 6,709,727 | B1 | | 3/2004 | Parker | |
| 6,725,508 | B1 | | 4/2004 | Noda et al. | |
| 6,726,423 | B2 | | 4/2004 | Hocking | |
| 6,746,050 | B2 | | 6/2004 | Peleman | |
| 6,764,242 | B1 | | 7/2004 | Karten | |
| 7,153,076 | B2 | | 12/2006 | Parker | |
| 2006/0061085 | A1 | | 3/2006 | Peleman | |
| 2008/0018089 | A1 | | 1/2008 | Hoarau | |
| 2008/0093836 | A1 | | 4/2008 | Hoarau | |
| 2008/0141503 | A1 | | 6/2008 | Smith | |

FOREIGN PATENT DOCUMENTS

| | | | |
|---|---|---|---|
| DE | 8512806 | U1 | 6/1985 |
| DE | 202004017503 | U1 | 2/2005 |
| EP | 0995614 | | 4/2000 |
| FR | 792956 | | 4/1959 |
| GB | 620201 | | 3/1949 |
| GB | 744958 | | 2/1956 |
| GB | 2145033 | | 3/1985 |
| GB | 2266866 | | 11/1993 |
| GB | 2294903 | | 5/1996 |
| JP | 9216477 | | 8/1997 |
| JP | 20044330437 | | 11/2004 |
| JP | 2007001279 | | 1/2007 |
| KR | 20060051403 | | 5/2006 |
| WO | WO 9717210 | | 5/1997 |
| WO | 9727066 | | 7/1997 |
| WO | WO 03043834 | | 5/2003 |
| WO | 2008036290 | | 3/2008 |

OTHER PUBLICATIONS

U.S. Appl. No. 11/522,626, Final Rejection dated Jun. 24, 2009, pp. 1-7 and attachments.

U.S. Appl. No. 11/522,626, Office Action dated Sep. 23, 2008, pp. 1-8 and attachments.

U.S. Appl. No. 11/490,687, Office Action dated Jul. 30, 2009, pp. 1-13 and attachments.

U.S. Appl. No. 11/490,687, Final Rejection dated Mar. 23, 2009, pp. 1-13 and attachments.

U.S. Appl. No. 11/490,687, Office Action dated May 7, 2008, pp. 1-11 and attachments.

http://www.channelbind.com/chb-covr.htm "High Quality Presentation Covers" (1 page) dated on or before Aug. 2009.

http://www.powis.com "Fastback Hardcover Guide" User's Manual Rev. C, Jun. 9, 2005 (14 pages).

http://www.unibind.com/basic/binding/steelbinding/photobook.html "Photobooks" (2 pages) dated on or before Aug. 2009.

PCT/US2007/020251; Hewlett Packard Development Company, Ltd., International Search Report mailed Aug. 11, 2008 (7 pages).

PCT/US2007/020251: Hewlett Packard Development Company, Ltd., Written Opinion mailed Aug. 11, 2008 (11 pages).

* cited by examiner

SHEET RETENTION MECHANISMS FOR SPRING CLAMP BINDERS

CROSS-REFERENCE TO RELATED APPLICATIONS

This application is related to U.S. application Ser. No. 11/490,687, filed Jul. 21, 2006 (U.S. Patent Publication No. 2008/0018089), and U.S. application Ser. No. 11/522,626, filed Sep. 18, 2006 (U.S. Patent Publication No. 2008/0093836), both of which are incorporated herein by reference.

BACKGROUND

Binders are used for holding a wide variety of items, including sheets of physical media, such as loose sheets of paper and the like. A spring clamp binder includes a cover and at least one spring clamp, which applies a clamping force for retaining items inserted between the clamping surfaces of the spring clamp. In some spring clamp binders, a front cover and a back cover are attached to opposite sides of one or more spring clamps that are located in the spine of the binder. In operation, the front and back covers are folded back against the sides of the spring clamps, whereby the front and back covers act as levers and the spine acts as a fulcrum in opening the spring clamps to enable items to be inserted between the clamping surfaces of the spring clamps.

Currently available spring clamp binders typically are sufficient for informal and non-professional binding applications. Such binders, however, do not provide robust and aesthetically pleasing sheet retention capabilities, nor are they designed for efficient and cost-effective manufacture. Therefore, what are needed are spring clamp binders with improved sheet retention mechanisms that provide robust and aesthetically pleasing binding results and may be manufactured efficiently and cost-effectively.

SUMMARY

In one aspect, the invention features a spring clamp binder that includes a cover, at least one spring clamp defining a respective holding volume, and a datum bar. The datum bar includes a spacer that extends through the holding volume. The spacer has a planar datum surface that includes an elongate axial surface region and first and second surface region projections. The axial surface region defines a longitudinal axis. The first and second surface region projections protrude from respective locations along the axial surface region on respective sides of the spring clamp in different directions intersecting the longitudinal axis.

In another aspect, the invention features a spring clamp binder that includes a cover, at least one spring clamp defining a respective holding volume, a datum bar, a tension system, and at least one engagement feature. The datum bar includes a spacer extending through the holding volume and having a planar datum surface exposed to engage leading edges of sheets of physical media inserted within the holding volume. The tension system has a central portion and first and second side portions. The central portion is within the holding volume between the spacer and the spring clamp. Each of the first and second side portions is attached to the cover. The at least one engagement feature is exposed to engage sheets of physical media inserted within the holding volume.

In another aspect, the invention features a spring clamp binder that includes a cover, at least one spring clamp defining a respective holding volume, a datum bar, and a tension system. The datum bar includes a spacer extending through the holding volume and having a planar datum surface exposed to engage leading edges of sheets of physical media inserted within the holding volume. The tension system has a central portion and first and second side portions. The central portion is within the holding volume between the spacer and the spring clamp. Each of the first and second side portions is attached to the cover. The spring clamp binder additionally includes at least one attachment mechanism between the spacer and the spring clamp.

In another aspect, the invention features a method in accordance with which a tension system is positioned between at least one spring clamp defining a respective holding volume and a datum bar. The datum bar includes a spacer that has a planar datum surface. The planar datum surface includes an elongate axial surface region and first and second surface region projections. The axial surface region defines a longitudinal axis. The first and second surface regions projections protrude from respective locations along the axial surface region in different directions intersecting the longitudinal axis. The spring clamp is attached to the datum bar with the datum bar and the tension system extending through the holding volume and the surface region projections protruding from the axial surface region on respective sides of adjacent ones of the spring clamps. Opposite side portions of the tension system are affixed to a cover.

Other features and advantages of the invention will become apparent from the following description, including the drawings and the claims.

DETAILED DESCRIPTION

In the following description, like reference numbers are used to identify like elements. Furthermore, the drawings are intended to illustrate major features of exemplary embodiments in a diagrammatic manner. The drawings are not intended to depict every feature of actual embodiments nor relative dimensions of the depicted elements, and are not drawn to scale.

I. Introduction

The embodiments that are described herein provide spring clamp binders that include sheet retention mechanisms that provide improved performance and increase manufacturing efficiency and cost-effectiveness. As used herein the term "spring clamp binder" refers to a device that has a cover and one or more spring clamps for holding one or more items, including sheets of physical media, such as loose sheets of paper, pages of a photoalbum, and other types of physical media.

Some embodiments include a datum bar that has a planar datum surface against which physical media sheets may be registered so that the opposite ends of the sheets present a clean edge to the user. The datum bar also limits the insertion depth of physical media sheets into the spring clamps to reduce the marginal portions of the physical media sheets that are obscured by the sheet retention mechanism.

Some of these embodiments include one or more spring clamps, which are distributed at spaced apart locations along the datum bar. In some of these embodiments, the planar datum surface includes surface region projections that protrude from the axial surface region on respective sides of at least one of the spring clamps to inhibit insertion of physical media sheets between the datum bar and the spring clamps. In this way, these embodiments increase the likelihood that all the sheets loaded into the spring clamp binder will be aligned properly against the planar datum surface.

Some embodiments include engagement features that engage physical media that are loaded into the spring clamp binder. The engagement features increase the strength with which the spring clamp binder retains the physical media. In this way, these embodiments reduce the likelihood of the physical media inadvertently falling out of the spring clamp binder as a result of accidental bumping or dropping the binder.

Some embodiments include attachment mechanisms between the spring clamps and the datum bar. The attachment mechanisms reduce the number of component parts needed to manufacture the spring clamp binders and reduce the complexity of the manufacturing process. In this way, these embodiments enable the spring clamp binders to be manufactured efficiently and cost-effectively.

II. Overview

Figure 1:
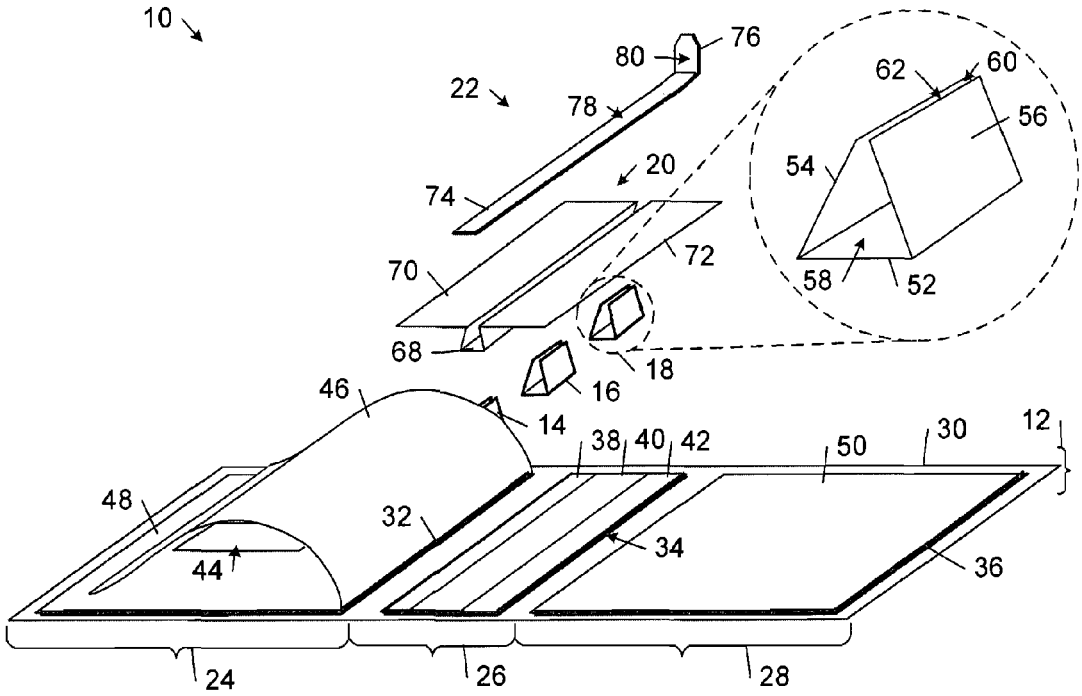
FIG. 1 is an exploded view of an embodiment of a spring clamp binder.

FIG. 1 shows an exploded view of an embodiment of a spring clamp binder 10 that includes a cover 12, three spring clamps 14, 16, 18, a tension system 20, and a datum bar 22. Other embodiments may include a smaller number (i.e., one or two) of spring clamps or a greater number (i.e., more than three) of spring clamps The cover 12 includes a front part 24, a spine part 26, and a back part 28. Each of the front, spine, and back parts 24-28 of the cover 12 typically is formed of multiple material layers, including an outer covering layer 30 and front, spine, and back base layers 32, 34, 36. The outer covering layer 30 typically is formed of a durable material (e.g., a textile). The central region of the outer covering 30 are attached to the outwardly facing surfaces of the base layers 32-36, whereas the marginal edges of the outer covering layer 30 typically are folded over the side edges of the base layers 32-26 and attached to the inwardly facing surfaces of the base layers 32-36. The base layers 32-36 typically are formed of a rigid planar material (e.g., paperboard or a stiff polymeric material). In the illustrated embodiment, the spine base layer 34 is segmented into three sections 38, 40, 42 to facilitate bending during opening and closing of the spring clamp binder 10. In other embodiments, the spine base layer 24 may be unsegmented or it may be segmented into two or more than three segments.

In the illustrated embodiment, the front part 24 of the cover 12 includes an optional window 44, which allows users to see an image on the first front facing one of physical media sheets loaded into the spring clamp binder 10. The illustrated embodiment also includes an optional protective sheet 46 that is affixed to the front base layer 32. In general, the protective sheet 46 may be formed of a wide variety of different materials, including an acetate material, a single or composite polymeric film, or vellum. The protective sheet 46 typically is made of a transparent material in embodiments in which the window 38 is present. A decorative front pastedown sheet 48 typically is attached to the inwardly facing surface of the front base layer 32 over the frontside marginal edges of the outer covering layer 30 and over a folded down edge of the protective sheet 46 (if present). A decorative back pastedown sheet 50 also typically is attached to the inwardly facing surface of the back base layer 36 over the backside marginal edges of the outer covering layer 30.

In general, the spring clamps 14-18 may be implemented in a wide variety of different ways. In some embodiments, the spring clamps 14-18 are implemented in accordance with any of the spine clamp embodiments disclosed in U.S. application Ser. No. 11/490,687, filed Jul. 21, 2006, and U.S. application Ser. No. 11/522,626, filed Sep. 18, 2006. In the embodiment illustrated in FIG. 1, each of the spring clamps 14-18 is formed of a rectangular sheet of material (e.g., spring steel, sheet metal, or a resilient polymeric material) that is bent along two parallel fold lines to form a backside 52 and two clamping sides 54, 56, which have inner surfaces that define a respective holding volume in the shape of a triangular cylinder. The opposing terminal ends of the clamping sides 54, 56 have clamping surfaces 60, 62, which hold items inserted therebetween.

In some embodiments, the spring clamps 14-18 are formed in a normally closed state in which the clamping surfaces 60, 62 are normally in-contact with one another and apply a specified preload force between the clamping surfaces 60, 62. In these embodiments, the spring clamp binder 10 is in a closed state when no items are held between the clamping surfaces 60, 62. This feature reduces the risk that sheets of physical media may become inadvertently captured by or entangled with the spring clamps. In some embodiments, the spring clamps 14-18 may be configured to apply a preload force of at least approximately 0.1 pounds per linear inch. In some embodiments, the spring clamps 14-18 apply to sheets of physical media inserted between the clamping surfaces 60, 62 a clamping force that is in a range of approximately 1 to 5 pounds per linear inch. The clamping force may be measured by measuring the force needed to open the clamp by pulling at the edges of the clamp where the clamping surfaces meet.

In operation, the front and back parts 24, 28 of the cover 12 are folded back against the clamping sides of the spring clamps 14-18, whereby the front and back parts 24, 28 act as levers and the spine part 26 as a fulcrum in opening the spring clamps 14-18 to enable items to be inserted between the clamping surfaces 60, 62 of the spring clamps 14-18. In response to a sufficient applied force, the opposing inner surfaces of the clamping sides 54, 56 of the spring clamps 14-18 move away from one another from a closed state to an open state.

Figure 2:
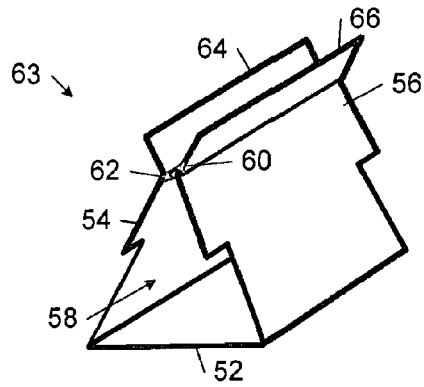
FIG. 2 is a perspective view of an embodiment of a spring clamp.

FIG. 2 shows an embodiment 63 of a spring clamp in which the opposing terminal ends of the clamping sides 54, 56 have respective edge features 64, 66. In this embodiment, the edge features 64, 66 are outwardly creased portions of the terminal ends of the clamping sides 54, 56. Other embodiments may include different edge features, including any of the edge features disclosed in U.S. application Ser. No. 11/490,687, filed Jul. 21, 2006.

Referring back to FIG. 1, the tension system 20 may be composed of one or more of a wide variety of different material compositions. The tension system 20 typically includes a substantially inelastic body, which may be formed of, for example, one or more of a substantially inelastic polymeric compound and a substantially inelastic textile fabric. The tension system 20 has a central portion 68 and first and second side portions 70, 72. During assembly of the spring clamp binder 10, the central portion 68 of the tension system 20 is secured within the holding volumes 58 of the spring clamps 14-18 between the datum bar 22 and the inner surfaces of spring clamps 14-18. The first and second side portions 70, 72 of the tension system 20 are attached to the front and back parts 24, 28 of the cover 12, respectively. In this way, the tension system 20 is operable to transmit an opening force from the front and back parts 24, 28 of the cover 12 to the clamping surfaces 60, 62 of the spring clamps 14-18.

The datum bar 22 includes a spacer 74 and an integral datum stop 76. As explained in detail below, attachment mechanisms secure the spring clamps 14-18 and the tension system 20 to the spacer 74. After assembly of the spring clamp binder 10, the spacer 74 extends through the holding volumes 58 of the spring clamps 14-18 and the spring clamps 14-18 are secured at spaced apart locations along the spacer 74. The spacer 74 has a planar datum surface 78 against which physical media sheets may be registered so that the opposite ends of the sheets present a clean edge to the user. The datum surface 78 also limits the insertion depth of physical media sheets into the spring clamps 14-18 to reduce the marginal portions of the physical media sheets that are obscured by the sheet retention mechanism. In this regard, the spacer 74 has a thickness that positions the datum surface 78 a desired height above the central portion 68 of the tension system 20 within the holding volumes 58 of the clamps. The datum stop 76 is disposed at a distal end of the spacer 74. The datum stop 76 has a datum stop surface 80 that is orthogonal to the datum surface 78. The datum stop surface 80 provides a second edge against which physical media sheets may be registered to achieve an aesthetically pleasing binding of the physical media sheets with aligned edges. In some embodiments, a second datum stop may be provided at the opposite end of the spacer 74. The datum bar 22 typically is formed of a rigid material (e.g., a rigid plastic or metal material.

III. Exemplary Sheet Retention Mechanisms

A. Inhibiting Insertion of Physical Media Sheets Below the Planar Datum Surface

As explained above, some embodiments include one or more spring clamps, which are distributed at spaced apart locations along the datum bar. In some of these embodiments, the planar datum surface includes surface region projections that protrude from the axial surface region on respective sides of at least one of the spring clamps to inhibit insertion of physical media sheets between the datum bar and the spring clamps. In this way, these embodiments increase the likelihood that all the sheets loaded into the spring clamp binder will be aligned properly against the planar datum surface.

Figure 3A:
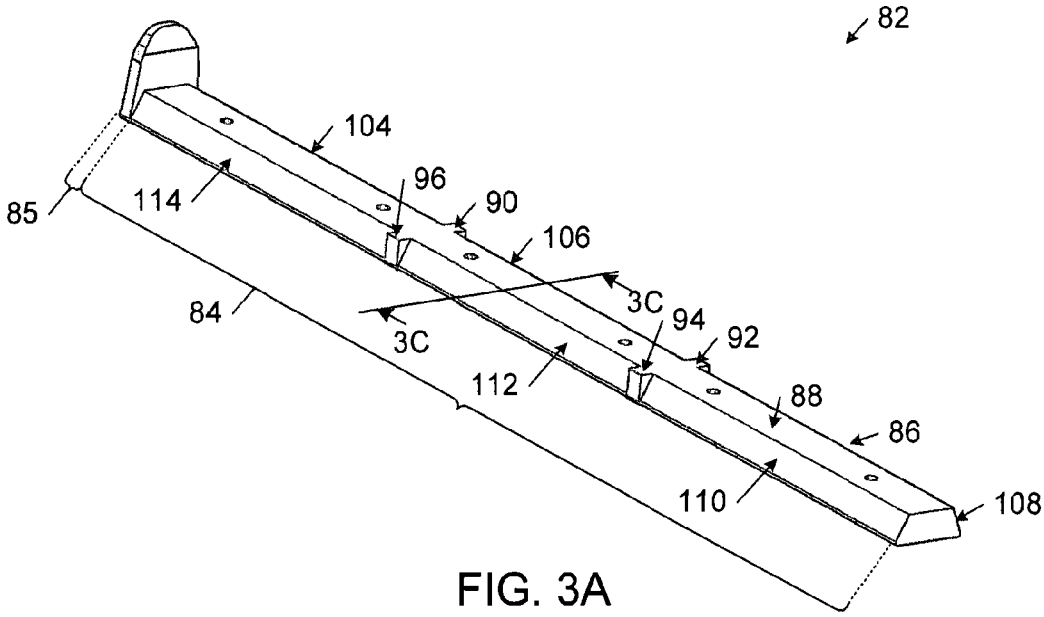
FIG. 3A is a perspective view of an embodiment of a datum bar.
Figure 3B:
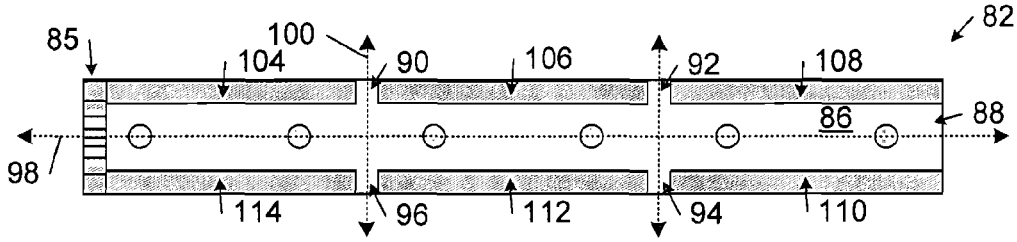
FIG. 3B is a top view of the datum bar shown in FIG. 3A.
Figure 3C:
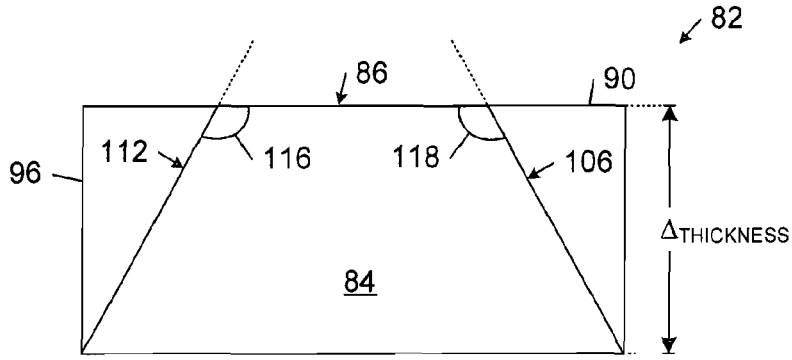
FIG. 3C is a cross-sectional view of the datum bar shown in FIG. 3A taken along the line 3C-3C.

FIGS. 3A, 3B, and 3C respectively show perspective, top, and cross-sectional side views of an embodiment 82 of the datum bar 22 (see FIG. 1) that includes a spacer 84 and an integral datum stop 85. In some embodiments, the datum bar 82 is formed of a single molded plastic part. The spacer 84 has a planar datum surface 86 that includes an elongate axial surface region 88 and surface region projections 90, 92, 94, 96. The axial surface region 88 defines a longitudinal axis 98 (see FIG. 3B). The surface region projections 90, 96 respectively protrude from respective locations along the axial surface region 86 in different directions that intersect the longitudinal axis 98. Similarly, the surface region projections 90, 96 respectively protrude from respective locations along the axial surface region 86 in different directions intersecting the longitudinal axis. In the illustrated embodiment, the surface region projections 90, 96 protrude in opposite directions along a common axis 100 that is transverse to the longitudinal axis 98. The surface region projections 92, 94 also protrude in opposite directions along a common axis 102 that is transverse to the longitudinal axis 98. In other embodiments, the surface region projections 90, 96 may protrude in different directions along nonparallel axes that intersect the longitudinal axis 98 at different locations. Likewise, the surface region projections 92, 94 may protrude in different directions along nonparallel axes that intersect the longitudinal axis 98 at different locations.

As shown in FIGS. 3A-3C, the spacer 84 includes planar side surfaces 104, 106, 108, 110, 112, 114, which are parallel to the longitudinal axis and intersect the axial surface region 86 at respective obtuse angles 116, 118. In the illustrated embodiment, the obtuse angles 116-118 are equal. In general, some or all of the angles of intersection between the planar side surfaces 104-114 and the axial surface region 86 may be the same or different. In some embodiments, the complementary intersection angles between the planar side surfaces 104-114 and the bottom side of the spacer are substantially equal (i.e., ±5%) to the angles formed between the back and clamping sides of the spring clamps.

Figure 4A:
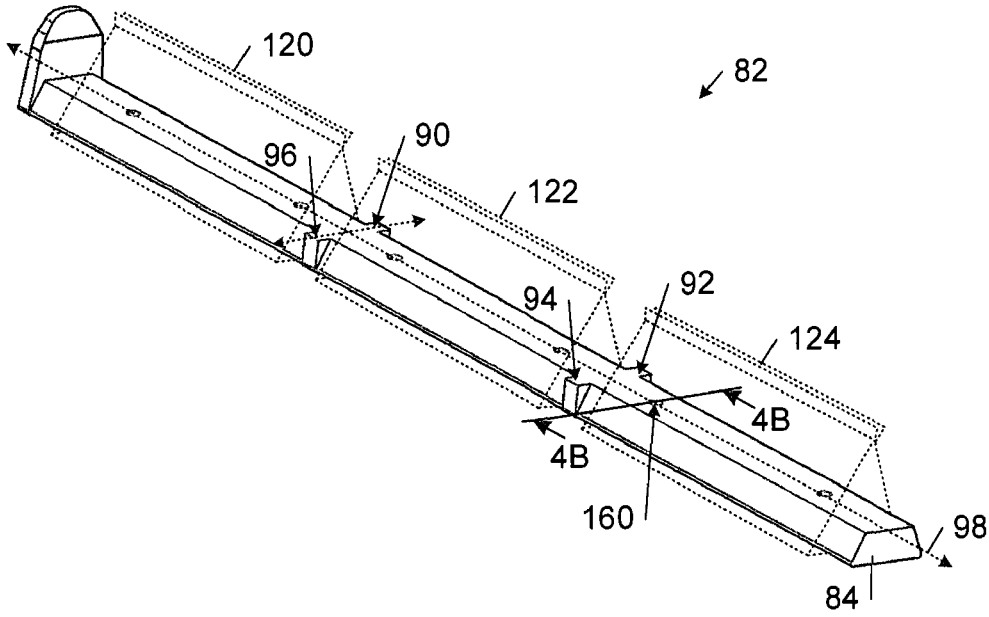
FIG. 4A is a perspective view of three exemplary spring clamps shown in phantom superimposed over the embodiment of the datum bar shown in FIG. 3A.

Referring to FIG. 4A, after assembly, the surface region projections 90-96 project from the axial surface region 86 on respective sides of the spring clamp 122. In particular, the surface region projection 90 projects from the axial surface region 86 on the bottom left side of the spring clamp 122; the surface region projection 92 projects from the axial surface region 86 on the top left side of the spring clamp 122; the surface region projection 94 projects from the axial surface region 86 on the top right side of the spring clamp 122; and the surface region projection 96 projects from the axial surface region 86 on the bottom right side of the spring clamp 122. In the illustrated embodiment, the surface region projections 90-96 project from locations within gaps between adjacent pairs of spring clamps 120, 122, 124. In this embodiment, the surface region projections 90-96 protrude between adjacent ones of the spring clamps 120-124 to inhibit insertion of physical media sheets between the spacer 84 and the spring clamps 120-124. This feature increases the likelihood that all the sheets loaded into the spring clamp binder will be aligned properly against the planar datum surface 86.

Figure 4B:
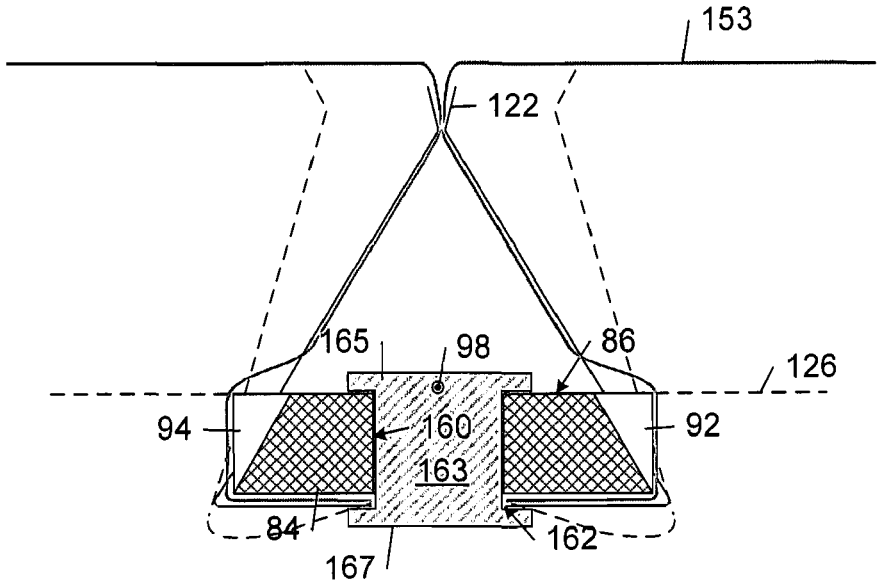
FIG. 4B is a cross-sectional view of one of the spring clamps and the datum bar shown in FIG. 4A taken along the line 4B-4B.

As shown in FIG. 4B, each of the spring clamps 120, 122 has opposing inner clamp surfaces that are operable to move toward and away from one another between a closed state and an open state (shown in phantom). A datum plane 126 coincident with the datum surface 86 intersects the opposing inner clamp surfaces in the open state at distances from the longitudinal axis 98 less than or equal to distances at which the surface region projections terminate from the longitudinal axis 98. In this way, the surface region projections 90-96 are able to inhibit insertion of physical media sheets between the spacer 84 and the spring clamps 120-124 throughout the normal range of motion of the clamping sides of the spring clamps 120-124. As used herein, the term "distance" refers to the shortest (i.e., perpendicular) distance.

B. Engagement Features for Engaging Sheets of Physical Media

As explained above, some embodiments include engagement features that engage sheets of physical media that are loaded into the spring clamp binder. The engagement features increase the strength with which the spring clamp binder retains sheets. In this way, these embodiments reduce the likelihood of the physical media sheets inadvertently falling out of the spring clamp binder as a result of accidental bumping or dropping the binder.

In some embodiments, the spring clamp binder 10 includes at least one engagement feature that is exposed for engaging sheets of physical media inserted within the holding volumes of the clamps 14-18.

Figure 5:
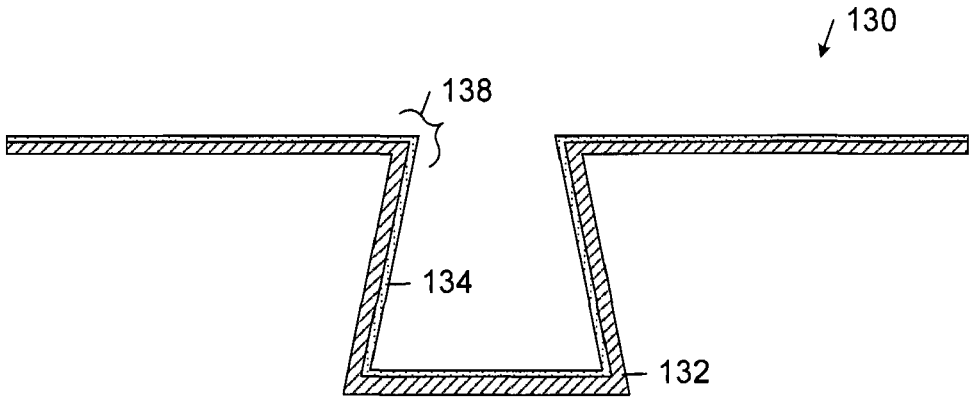
FIG. 5 is a cross-sectional view of an embodiment of a tension system that includes an engagement feature for engaging sheets of physical media.

FIG. 5 shows an embodiment 130 of the tension system 20 (see FIG. 1) that includes a substantially inelastic base layer 132 and a friction layer 134. The base layer 132 may be formed of, for example, one or more of a substantially inelastic polymeric compound and a substantially inelastic textile fabric. The friction layer 134 has a higher coefficient of friction than the base layer 132. In some embodiments, the friction layer 134 includes a polymeric material. The polymeric material may be formed of, for example, at least one of rubber, silicone-based resins, polyvinyl chloride (PVC), neoprene, polyurethane polymers, and amino resins, such as urea-formaldehyde-melamine (e.g., ULY). In some embodiments, the friction layer 134 presents an exposed textured surface that increases the frictional engagement between the tension system 130 and sheets of physical media inserted with the holding volumes of the spring clamps. In some of these embodiments, the textured surface may be provided by an embossed surface of the friction layer 134 or by particles (e.g., sand particles) that are embedded in the friction layer 134.

The friction layer 134 typically is disposed over the regions 138 of the tension system 130 between the opposing clamping surfaces of the spring clamps. In some of these embodiments, the friction layer 134 is disposed only over the central portion of the tension system 130. In other ones of these embodiments, the friction layer 134 is disposed over the entire base layer 132, as shown in FIG. 5.

In some embodiments, the engagement features include gripping elements that concentrate the forces applied by the spring clamps to produce local deformations of the physical media sheets and thereby increase the holding strength of the spring clamp binder.

Figure 6:
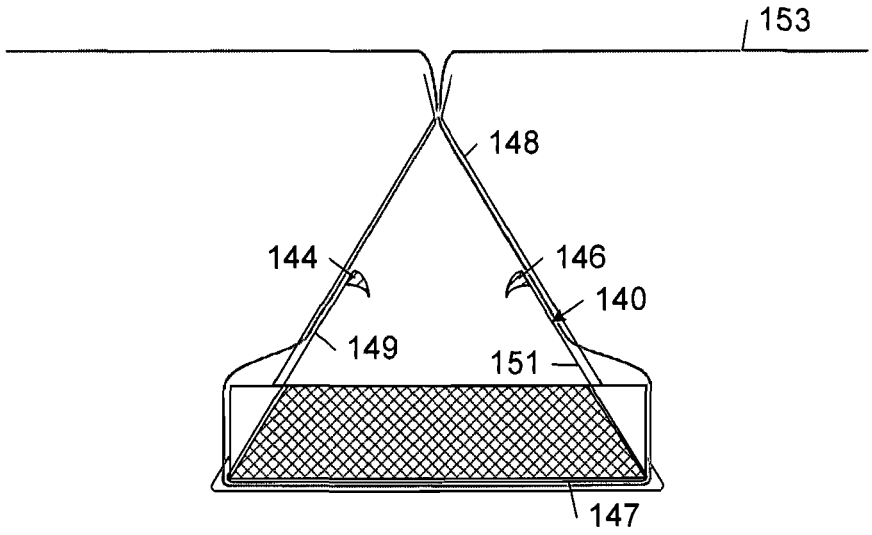
FIG. 6 is a cross-sectional view of an embodiment of a sheet retention mechanism that includes an engagement feature for engaging sheets of physical media.

FIG. 6 shows an embodiment of an engagement feature 140 that includes a pair of opposed gripping elements 144, 146 each with a respective tooth (or pointed tip). In this embodiment, the engagement feature 140 includes a base portion 147 and toothed portions 149, 151 that project from the base portion 147 into the holding volume of a spring clamp 148 adjacent a tension system 153. In the illustrated embodiment, the toothed portions are curved downward towards the spine part 26 to facilitate loading of the physical media sheets into the spring clamp binder 10. In operation, the clamping sides of the spring clamp 148 apply inwardly directed closing forces to the engagement feature 140. These forces drive the teeth of the gripping elements 144, 146 into sheets of physical media inserted within the holding volume of the spring clamp 148. Since the areas where the teeth contact the physical media sheets are smaller than the areas over which the clamping sides apply the closing forces to the engagement feature 140, the teeth concentrate the transmission of closing forces to local areas of the physical media sheets. The teeth of the engagement feature 140 also may produce location deformations in at least the outer ones of the physical media sheets. These deformations increase the mechanical retention of the physical media sheets within the holding volume of the spring clamp 148.

C. Attaching Spring Clamps to the Spacer

As explained above, some embodiments include attachment mechanisms between the spring clamps and the datum bar. The attachment mechanisms reduce the number of component parts needed to manufacture the spring clamp binders and reduce the complexity of the manufacturing process. In this way, these embodiments enable the spring clamp binders to be manufactured efficiently and cost-effectively.

In some embodiments, the attachment mechanisms include coupling members that are inserted into holes formed through the backside of the spring clamps.

Referring back to FIGS. 4A and 4B, in the illustrated embodiment, the datum bar 82 includes a set of holes 160 passing through the spacer 84 in directions normal to the planar datum surface 86. In general, each of the spring clamps includes at least one hole that is aligned with a respective hole in the spacer. In the illustrated embodiment, each of the spring clamps 120-124 includes a pair of holes 162 that are aligned with a respective pair of the holes 160 in the spacer 84. During manufacture, a coupling member (e.g., a screw, rivet, or heat stake) is inserted through each of the matching holes in the spacer 84 and the spring clamps 120-124. In this process, each coupling member 163 has one end 165 that is secured to the spacer 84 and an opposite end 167 that is secured to a respective one of the spring clamps 120-124. In some embodiments, the coupling members are secured to the spacer 84 and the spring clamps 120-124 while the spring clamps 120-124 are in an open state (shown in phantom). This method of attachment ensures that there are gaps between the spacer 84 and the spring clamps 120-124 when the spring clamps return to the closed state, as explained below in connection with FIGS. 8A-8C. These gaps enable freedom of movement of the spring clamps 120-124 in relation to the spacer 84 during opening and closing of the spring clamps 120-124.

Figure 7A:
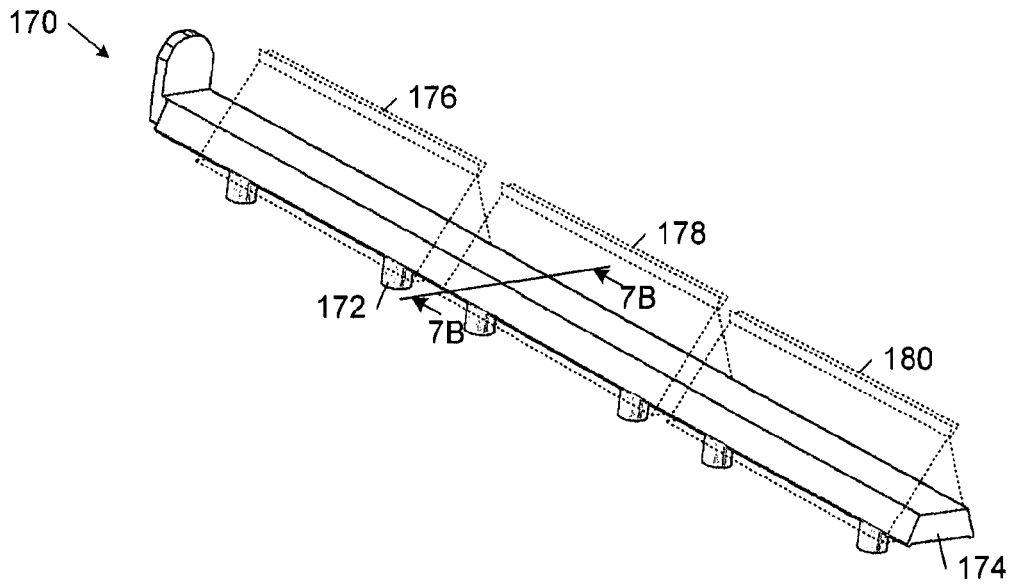
FIG. 7A is a perspective view of three exemplary spring clamps shown in phantom superimposed over an embodiment of a datum bar.
Figure 7B:
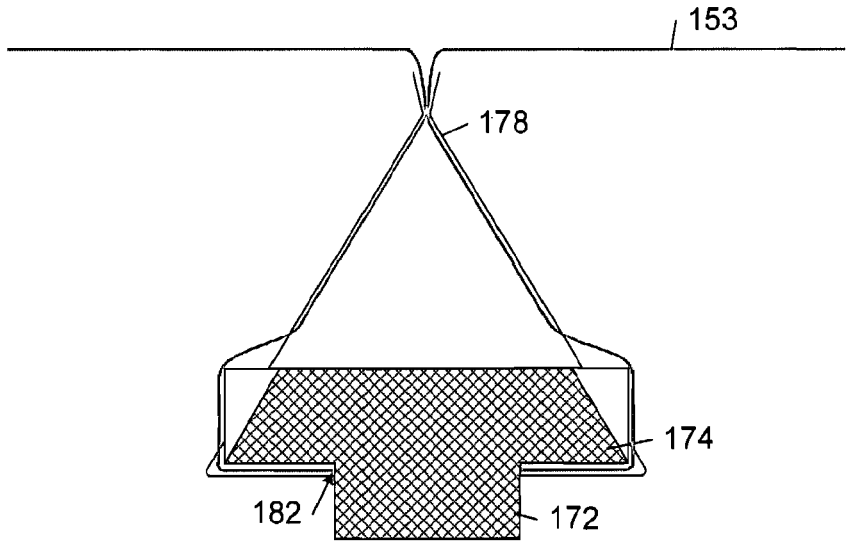
FIG. 7B is a cross-sectional view of one of the spring clamps and the datum bar shown in FIG. 7A taken along the line 7B-7B.

FIGS. 7A and 7B show an embodiment 170 of the datum bar 22 (see FIG. 1) that includes a set of coupling members 172 (e.g., heat stakes, screws, or rivets) that protrude from a bottom surface of a spacer 174. Each of the spring clamps 176, 178, 180 includes a pair of holes 182 that are aligned with a respective pair of the coupling members 172 protruding from the spacer 174.

Figure 8A:
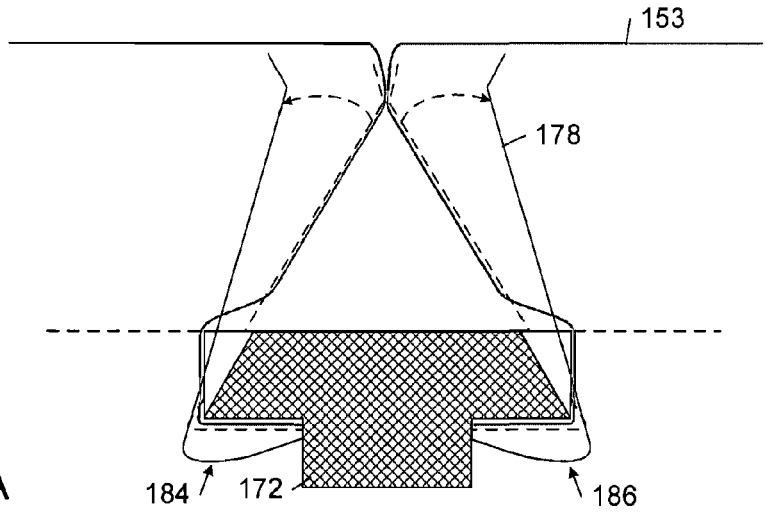
FIG. 8A is a cross-sectional view of the spring clamp and the datum bar shown in FIG. 8B with the spring clamp in an open state.
Figure 8B:
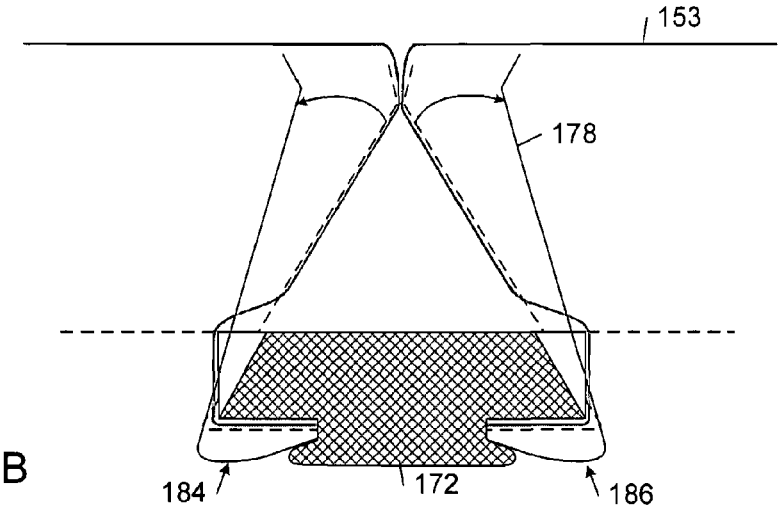
FIG. 8B is a cross-sectional view of the spring clamp and the datum bar shown in FIG. 8A after a coupling member of the datum bar has been heat staked to the spring clamp.
Figure 8C:
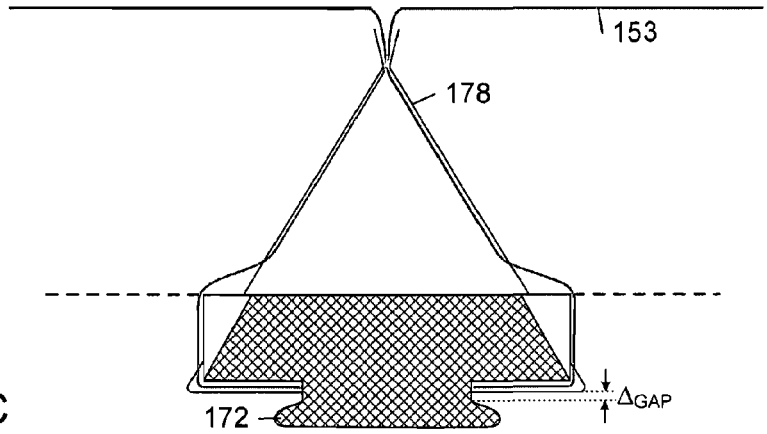
FIG. 8C is a cross-sectional view of the spring clamp and the datum bar shown in FIG. 8B with the spring clamp in a closed state.

Referring to FIGS. 8A-8C, in some embodiments, the coupling members 172 are inserted through the matching holes 180 in the spring clamps 176-180 while the spring clamps 120-124 are in an open state, as shown in FIG. 8A. The coupling members 172 are secured to the spring clamps 176-180 while the clamps 176-180 still are in the open state. In the illustrated embodiment, the coupling members 172 are heat stakes, which are deformed by heating to secure the spring clamps 176-180 to the spacer 172. In other embodiments, the spring clamps may be secured to the datum bar in other ways including, for example, one or more of gluing, bonding, welding, and crimping. As shown in FIG. 8B, in the open state, the side edges 184, 186 of bottom parts of the spring clamps 176-180 bend away from the bottom side of the spacer 172. Therefore, at least the peripheral portions of the melted ends of the heat stakes 172 are displaced away from the bottom side of the spacer 172. As a result, there are gaps ($\Delta_{GAP}$) between the spacer 172 and the spring clamps 176-180 when the spring clamps 176-180 return to the closed state. These gaps enable freedom of movement of the spring clamps 176-180 in relation to the spacer 172 during opening and closing of the spring clamps 176-180.

In some embodiments, the attachment mechanisms include engagement features of the spacer and the spring clamp that mechanically interlock with one another.

Figure 9A:
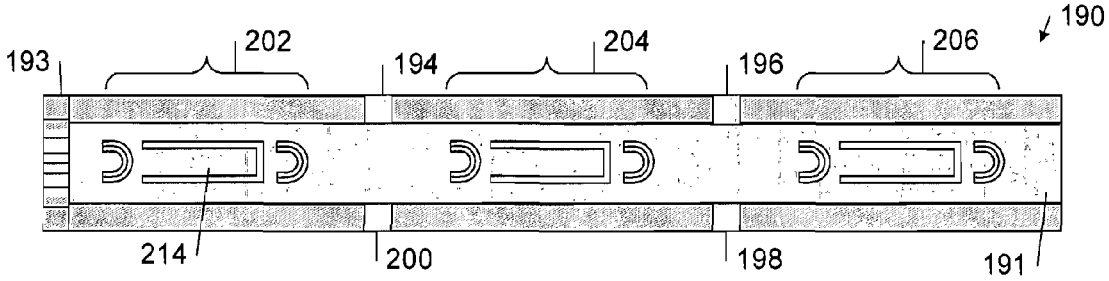
FIG. 9A is a top view of an embodiment of a datum bar.
Figure 9B:
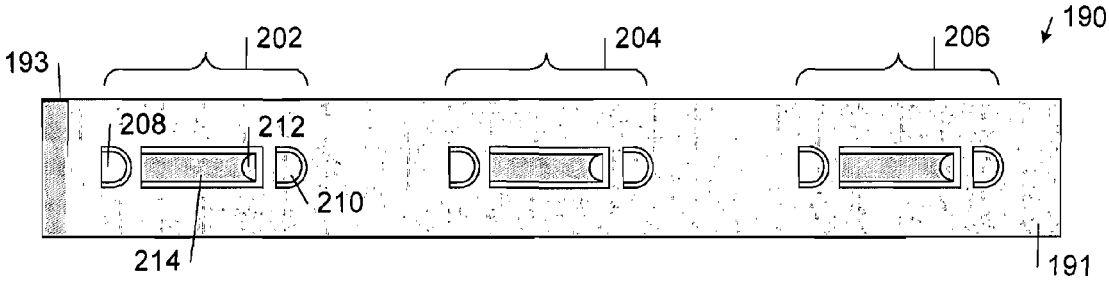
FIG. 9B is a bottom view of an embodiment of the datum bar shown in FIG. 9A.
Figure 9C:
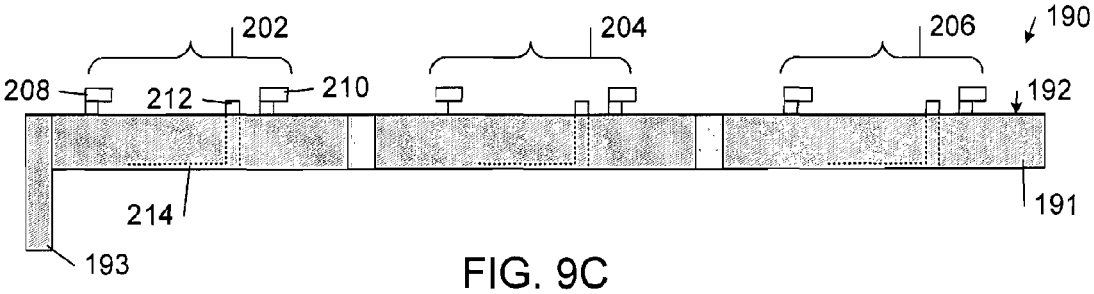
FIG. 9C is a side view of an embodiment of the datum bar shown in FIG. 9A.

FIGS. 9A, 9B, and 9C respectively show top, bottom, and side views of an embodiment 190 of the datum bar 22 (see FIG. 1). The datum bar 190 includes a spacer 191 and datum stop 193. The spacer 191 has a planar datum surface 192 that includes peripheral surface region projections 194, 196, 198, 200. The datum bar 190 also includes three sets of engagement features 202, 204, 206, one for each spring clamp that is to be attached to the datum bar 190. Each of the engagement feature sets 202-206 includes two retention posts 208, 210 and a locking pin 212. The locking pin 212 is attached to the spacer 191 by a cantilever 214.

Figure 10A:
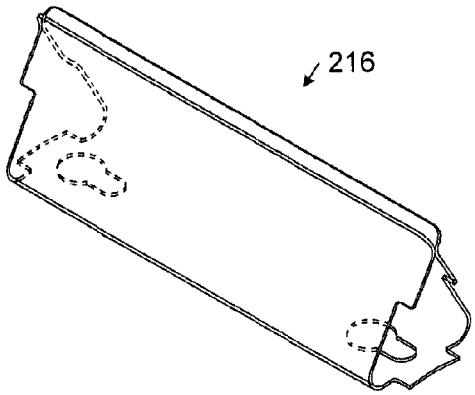
FIG. 10A is a perspective view of an embodiment of a spring clamp.
Figure 10B:
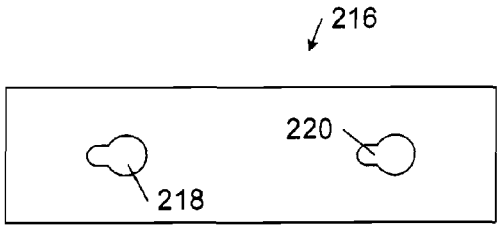
FIG. 10B is a bottom view of the spring clamp shown in FIG. 10A.

FIGS. 10A and 10B show an embodiment of a spring clamp 216 that includes a set of engagement features 218, 220 that mechanically interlocks with a respective one of the engagement feature sets 202-206 of the spacer 191. In this embodiment, the engagement features 218, 220 are keyhole openings through the backside 222 of the spring clamp 216. During manufacture, the retention posts 208, 210 projecting from the bottom of the spacer 191 are inserted into the larger diameter regions of the keyhole openings 218, 220. Next, the spring clamp 216 is slid in a longitudinal direction toward the datum stop 224 until the locking pin 212 is aligned with the larger diameter portion of the keyhole opening 220 at which point the spring force exerted by the cantilever 214 drives the locking pins into the keyhole opening 220 to mechanically lock the spring clamp 216 to the spacer 191.

Figure 11A:
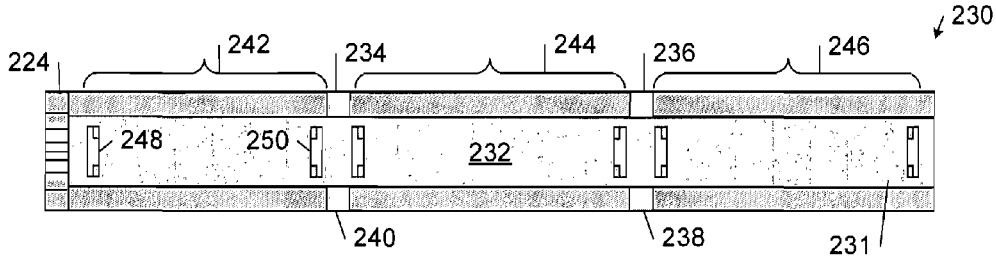
FIG. 11A is a top view of an embodiment of a datum bar.
Figure 11B:
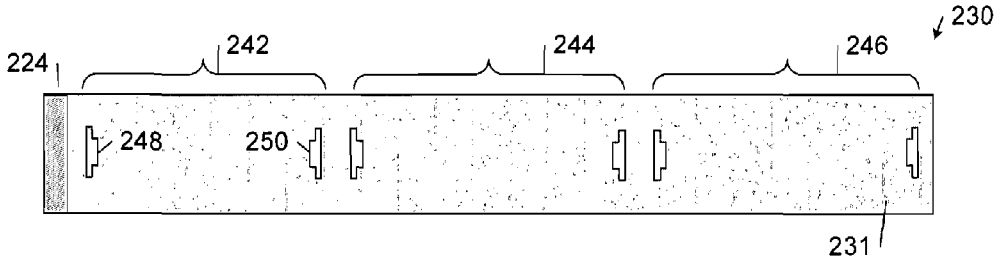
FIG. 11B is a bottom view of an embodiment of the datum bar shown in FIG. 11A.
Figure 11C:
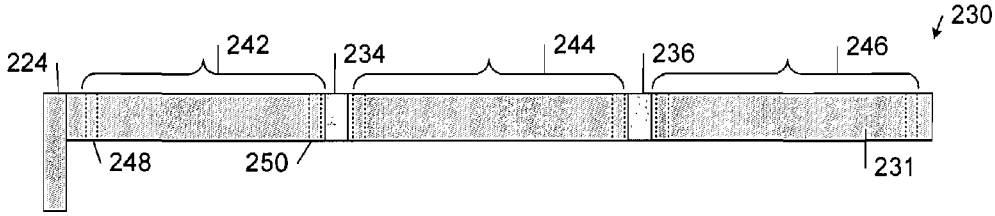
FIG. 11C is a side view of an embodiment of the datum bar shown in FIG. 11A.

FIGS. 11A, 11B, and 11C respectively show top, bottom, and side views of an embodiment 230 of the datum bar 22 (see FIG. 1). The datum bar 230 includes a spacer 231 with a planar datum surface 232, which has peripheral surface region projections 234, 236, 238, 240. The datum bar 230 also includes three sets of engagement features 242, 244, 246, one for each spring clamp that is to be attached to the datum bar 230. Each of the engagement feature sets 242-246 includes two locking through holes 248, 250.

Figure 12A:
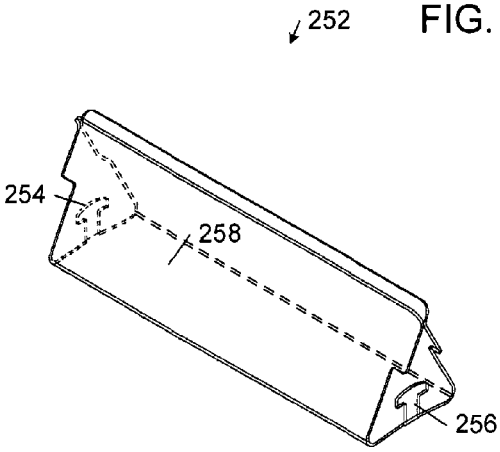
FIG. 12A is a perspective view of an embodiment of a spring clamp.
Figure 12B:
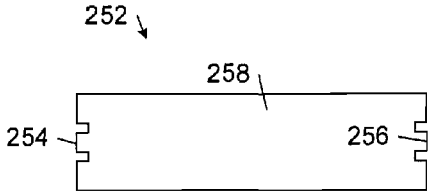
FIG. 12B is a bottom view of the spring clamp shown in FIG. 12A.

FIGS. 12A and 12B show an embodiment of a spring clamp 252 that includes a set of engagement features 254, 256 that mechanically interlocks with a respective one of the engagement feature sets 242-246 of the spacer 231. In this embodiment, the engagement features 254, 256 are cantilevered flanges that protrude from the backside 258 of the spring clamp 252. During manufacture of the spring clamp, the flanges 254, 256 projecting from the backside 258 of the spring clamp 252 are bent upwards and inserted into the locking through holes 248, 250 to mechanically lock the spring clamp 252 to the spacer 231.

Figure 13A:
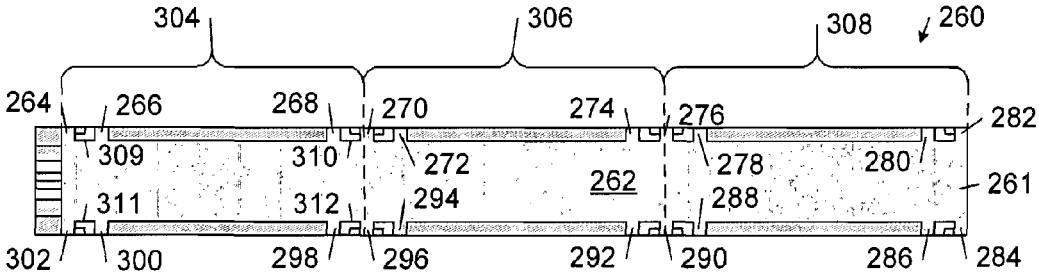
FIG. 13A is a top view of an embodiment of a datum bar.
Figure 13B:
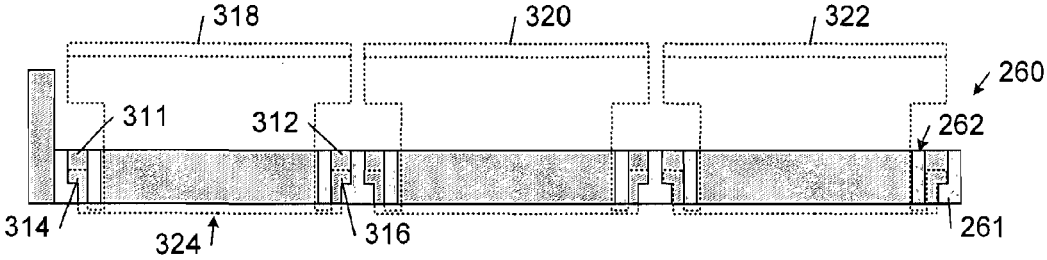
FIG. 13B is a side view of an embodiment of the datum bar shown in FIG. 13A with three copies of an embodiment of a spring clamp shown in phantom.

FIGS. 13A and 13B respectively show top and side views of an embodiment 260 of the datum bar 22 (see FIG. 1). The datum bar 260 includes a spacer 261 with a planar datum surface 262, which has peripheral surface region projections 264-302. The datum bar 260 also includes three sets of engagement features 304, 306, 308, one for each spring clamp that is to be attached to the datum bar 260. Each of the engagement feature sets 304-308 includes four sets of L-shaped grooves 309, 310, 311, 312. Each set of grooves 309-312 mechanically interlocks with a respective set of four L-shaped engagement features (only two features 314, 316 are shown in the view presented in FIG. 13B), with two engagement features on each of the opposed clamping sides of a respective one of three spring clamps 318, 320, 322. In this embodiment, the L-shaped engagement features 314, 316 of the spring clamps 318-322 are cantilevered flanges that protrude from the backsides 324 of the spring clamps 318-320. During manufacture, the flanges 314, 316 projecting from the backside 324 of the spring clamps 318-320 are bent upwards and inserted into the L-shaped grooves 310, 312 of the spacer 261 to mechanically lock the spring clamps 318-322 to the spacer 261.

IV. Manufacturing Spring Clamp Binders

Figure 14:
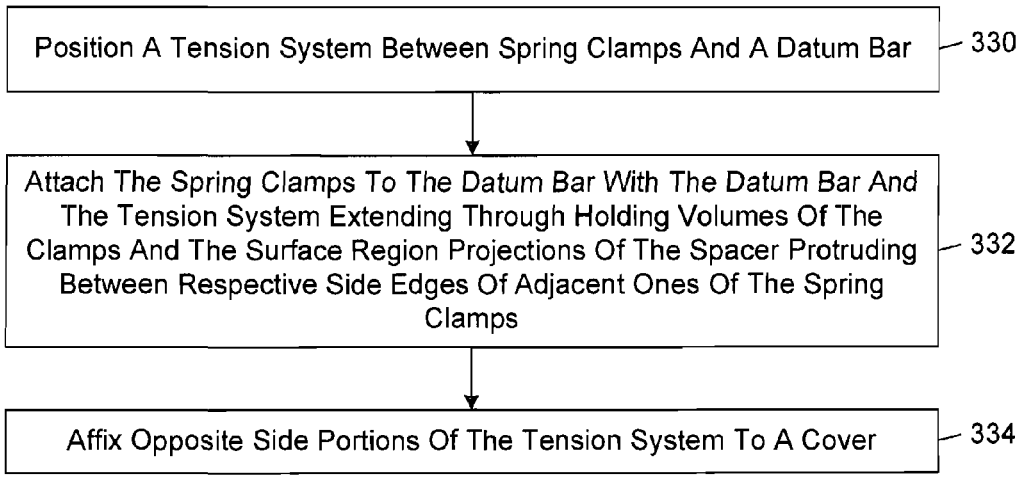
FIG. 14 is a flow diagram of an embodiment of a method of manufacturing an embodiment of a spring binder.

FIG. 14 shows an embodiment of a method of manufacturing the spring clamp binder 10, which is shown in FIG. 1.

In accordance with this method, a tension system is positioned between spring clamps and a datum bar (FIG. 14 block 330). The spring clamps define respective holding volumes. The datum bar includes a spacer that has a planar datum surface and includes an elongate axial surface region and first and second surface region projections. The axial surface region defines a longitudinal axis. The first and second surface region projections protrude from respective locations along the axial surface region in different directions intersecting the longitudinal axis.

The spring clamps are attached to the datum bar with the datum bar and the tension system extending through the holding volumes and the surface region projections protruding between respective side edges of adjacent ones of the spring clamps (FIG. 14, block 332). In some embodiments, the spring clamps are attached to the datum bar while the spring clamps are in an open state. In some embodiments, the spring clamps are attached to the datum bar by inserting a coupling member through respective holes in the spring clamps. In some of these embodiments, the spring clamps are attached to the datum bar by heat staking the datum bar to the spring clamps. In some embodiments, the spring clamps are attached to the datum bar by mechanically interlocking engagement features of the datum bar with respective engagement features of the spring clamps.

Opposite side portions of the tension system are affixed to a cover (FIG. 14, block 334). In some embodiments, an edge of a protective sheet also is affixed to the cover. A pastedown sheet typically is attached to the cover over the affixed edge of the protective sheet.

Figure 15A:
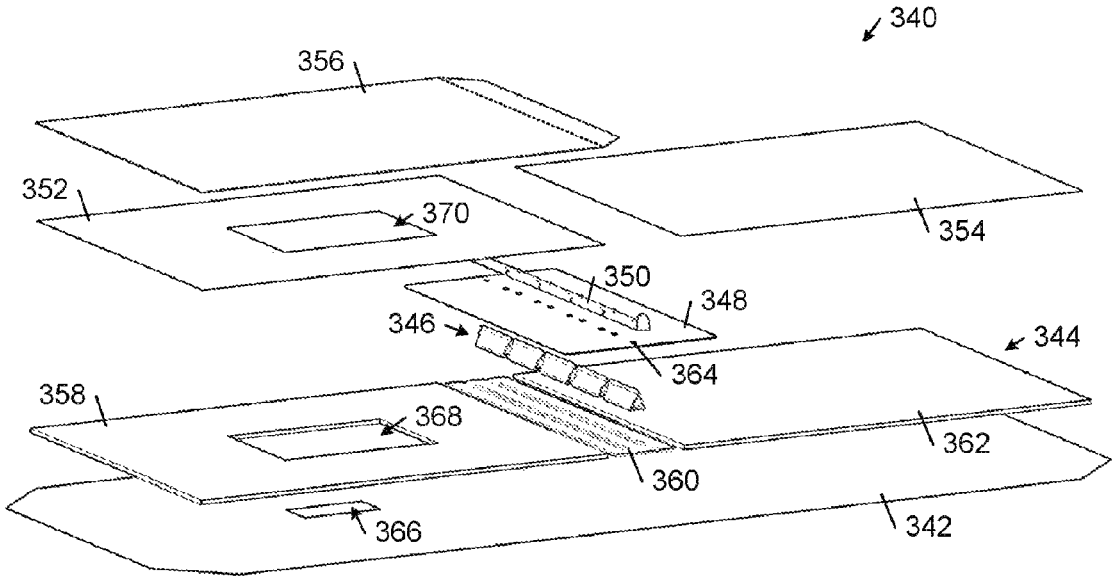
FIG. 15A is an exploded view of an embodiment of a spring binder.
Figure 15B:
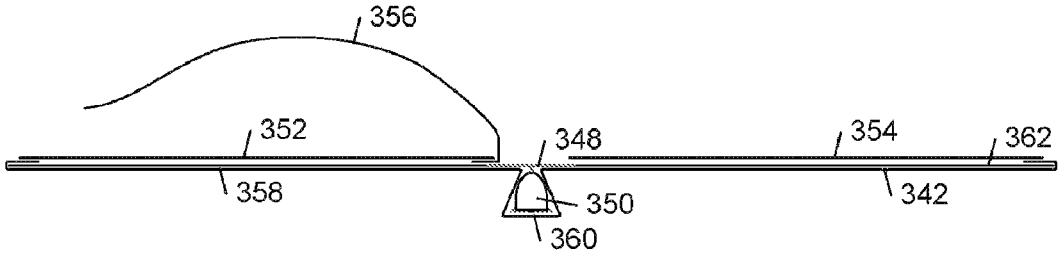
FIG. 15B is a diagrammatic side view of the spring binder shown in FIG. 15A.

FIGS. 15A and 15B respectively show an exploded view and a side view of an embodiment of a spring clamp binder 340 that is manufactured in accordance with an embodiment of the method shown in FIG. 14. The spring clamp binder 340 includes a covering layer 342, a base layer 344, a set 346 of five spring clamps, a tension system 348, a datum bar 350, front and back pastedown sheets 352, 354, and a protective sheet 356. The base layer 344 is segmented into a front part 358, a spine part 360, and a back part 362. The spine part 360 is divided into three sections to facilitate folding of the spine during opening and closing of the cover. The tension system 348 includes a set of predrilled holes 364 to facilitate the extension of a coupling member from the datum bar 350, through the tension system 348, to the set 346 of spring clamps. The covering layer 342, the base layer 344, and the front pastedown sheet 352 include respective openings 366, 368, 370 that are aligned to form a window in the front part of the cover.

V. Conclusion

The embodiments that are described herein provide spring clamp binders that include sheet retention mechanisms that provide improved performance and increase manufacturing efficiency and cost-effectiveness.

Other embodiments are within the scope of the claims.

What is claimed is:

1. A spring clamp binder, comprising:

a cover;

a first spring clamp and a second spring clamp, each of the first and second spring clamps defining a respective holding volume;

a datum bar comprising a spacer extending through the holding volume of each of the first and second spring clamps, and the datum bar further having a planar datum surface comprising:

an elongate axial surface region defining a longitudinal axis, and first and second surface region projections protruding from respective locations along the axial surface region on respective sides of the spring clamp in different directions intersecting the longitudinal axis, wherein the first and second surface region projections have respective planar surfaces that are co-planar with the planar datum surface, wherein the first spring clamp is spaced apart from the second spring clamp along the longitudinal axis such that a gap exists between the first and second spring clamps, wherein the first and second surface region projections are located in the gap, wherein the planar datum surface and the planar surfaces of the first and second surface region projections are exposed to engage leading edges of media sheets inserted into the holding volume of each of the first and second spring clamps.

2. The spring clamp binder of claim 1, wherein the first and second surface region projections protrude beyond respective side edges of the first and second spring clamps to inhibit insertion of physical media sheets between side surfaces of the spacer and the first and second spring clamps.

3. The spring clamp binder of claim 1, wherein each of the first and second spring clamps has opposing inner clamp surfaces that are operable to move toward and away from one another between a closed state and an open state, and a plane coincident with the datum surface intersects the opposing inner clamp surfaces in the open state at distances from the longitudinal axis less than or equal to distances at which the first and second surface region projections terminate from the longitudinal axis.

4. The spring clamp binder of claim 1, wherein the datum bar comprises an integral datum stop disposed at a distal end of the spacer and having a datum stop surface orthogonal to the datum surface.

5. The spring clamp binder of claim 1, wherein the spacer comprises first and second planar side surfaces parallel to the longitudinal axis and angled with respect to the datum surface, wherein the first and second surface region projections protrude beyond corresponding ones of the first and second planar side surfaces.

6. The spring clamp binder of claim 1, further comprising a pastedown sheet attached to the cover and a protective sheet with an edge folded under the pastedown sheet and affixed to the cover.

7. The spring clamp binder of claim 1, further comprising an attachment mechanism between the spacer and each of the first and second spring clamps, wherein the attachment mechanism provides gaps between the spacer and each of the first and second spring clamps enabling freedom of movement of the spring clamps in relation to the spacer during opening and closing of the spring clamps.

8. The spring clamp binder of claim 1, further comprising at least one engagement feature exposed for engaging the media sheets inserted within the holding volume defined by each of the spring clamps.

9. The spring clamp binder of 1, wherein the planar datum surface has side edges generally parallel to the longitudinal axis, and wherein the planar surfaces of the first and second surface region projections protrude beyond corresponding ones of the side edges.

10. The spring clamp binder of claim 1, wherein the first and second surface region projections are outside the holding volumes of the spring clamps.

11. The spring clamp binder of claim 1, further comprising a tension system having a central portion and first and second side portions, wherein the central portion is within the holding volume between the spacer and each of the first and second spring clamps, and each of the first and second side portions is attached to the cover.

12. The spring clamp binder of claim 11, wherein the cover has a front part, a spine part, and a back part, and wherein the front and back parts are foldable with respect to the spine part and folding movement of the front and back parts causes application of a lever action to open the spring clamp.

13. The spring clamp binder of claim 12, wherein the spine part when folded defines a space to hold the spring clamp.

14. A spring clamp binder, comprising:

a cover that defines a space;

at least one spring clamp defining a respective holding volume, wherein the spring clamp is provided in the space of the cover;

a datum bar comprising a spacer extending through the holding volume and having a planar datum surface exposed to engage leading edges of sheets of physical media inserted within the holding volume, wherein the planar datum surface extends generally along a longitudinal axis, and wherein the spacer further has side protrusions that protrude from respective sides of the spacer, and where the planar datum surface and planar surfaces of the side protrusions are co-planar and are exposed to engage the leading edges of the sheets of physical media, and wherein the planar surfaces of the side protrusions do not rise above the planar datum surface;

a tension system having a central portion and first and second side portions, wherein the central portion is within the holding volume between the spacer and the spring clamp, and each of the first and second side portions is attached to the cover; and at least one engagement feature exposed to engage sheets of physical media inserted within the holding volume.

15. The spring clamp binder of claim 14, wherein the spring clamp applies a force to the engagement feature and the engagement feature comprises at least one gripping element that concentrates a force applied by the spring clamp.

16. The spring clamp binder of claim 14, wherein the cover has a front part, a spine part, and a back part, wherein the front part and back part are foldable with respect to the spine part, and wherein the space is defined by the spine part.

17. The spring clamp binder of claim 14, wherein the side protrusions are outside of and spaced away from the spring clamp.

18. The spring clamp binder of claim 14, wherein the spring clamp is a first spring clamp, the spring clamp binder further comprising:

a second spring clamp spaced apart from the first spring clamp such that a gap is between the first and second spring clamps, wherein the side protrusions are in the gap.

19. The spring clamp binder of claim 14, wherein the spring clamp comprises opposing clamping edges operable to apply a clamping force therebetween, and the engagement feature comprises a friction surface on the tension system between the opposing clamping edges of the spring clamp.

20. The spring clamp binder of claim 19, wherein the tension system comprises a textile sheet and a friction coating providing the friction surface on the textile sheet and having a larger coefficient of friction than the textile sheet.

21. The spring clamp binder of claim 20, wherein the friction coating comprises a polymeric material.

22. A spring clamp binder, comprising:

a cover;

at least one spring clamp defining a respective holding volume;

a datum bar comprising a spacer extending through the holding volume and having a planar datum surface exposed to engage leading edges of sheets of physical media inserted within the holding volume;

a tension system having a central portion and first and second side portions, wherein the central portion is within the holding volume between the spacer and the spring clamp, and each of the first and second side portions is attached to the cover; and at least one engagement feature exposed to engage sheets of physical media inserted within the holding volume, wherein the spring clamp applies a force to the engagement feature and the engagement feature comprises at least one gripping element that concentrates a force applied by the spring clamp, wherein the engagement feature comprises a base portion coupled between the spacer and the spring clamp, and a toothed portion projecting from the base portion into the holding volume adjacent the tension system.

23. A spring clamp binder, comprising:

a cover;

a first spring clamp and a second spring clamp, wherein each of the first and second spring clamps defines a respective holding volume;

a datum bar comprising a spacer extending through the holding volume and having a planar datum surface exposed to engage leading edges of sheets of physical media inserted within the holding volume, wherein the planar datum surface has side edges generally parallel to a longitudinal axis of the spacer, and the spacer further comprises side protrusions protruding outwardly from the spacer past the side edges, wherein the side protrusions have planar surfaces that are co-planar with the planar datum surface, wherein the first spring clamp is spaced apart from the second spring clamp along the longitudinal axis such that a gap exists between the first and second spring clamps, wherein the side protrusions are located in the gap, and wherein the planar datum surface and the planar surfaces of the side protrusions are exposed to engage the leading edges of the sheets of physical media inserted into the holding volume of each of the first and second spring clamps;

a tension system having a central portion and first and second side portions, wherein the central portion is within the holding volume between the spacer and each of the first and second spring clamps, and each of the first and second side portions is attached to the cover; and at least one attachment mechanism between the spacer and the spring clamp.

24. The spring clamp binder of claim 23, wherein the attachment mechanism comprises engagement features of the spacer and the spring clamps that mechanically interlock with one another.

25. The spring clamp binder of claim 23, wherein the spacer further comprises side planar surfaces angled with respect to the planar datum surface, wherein the side protrusions protrude from the side planar surfaces.

26. The spring clamp binder of claim 23, wherein the attachment mechanism comprises a coupling member extending through a hole in each of the first and second spring clamps and having a first end attached to the spacer and a second end attached to each of the first and second spring clamps.

27. The spring clamp binder of claim 26, wherein the coupling member comprises a heat stake integral with and protruding from the spacer.

* * * * *